US008850854B2

(12) United States Patent
Morgan et al.

(10) Patent No.: US 8,850,854 B2
(45) Date of Patent: Oct. 7, 2014

(54) KNITTED FABRIC BED SKIRT

(75) Inventors: Andrew T. Morgan, White Plains, NY (US); Donna L. Melvin, Ambler, PA (US)

(73) Assignee: Tipping Point Enterprises LLC, New York, NY (US)

( * ) Notice: Subject to any disclaimer, the term of this patent is extended or adjusted under 35 U.S.C. 154(b) by 237 days.

(21) Appl. No.: 12/917,597

(22) Filed: Nov. 2, 2010

(65) Prior Publication Data

US 2011/0100067 A1 May 5, 2011

Related U.S. Application Data

(60) Provisional application No. 61/257,280, filed on Nov. 2, 2009.

(51) Int. Cl.
*D04B 1/22* (2006.01)
*A47C 27/06* (2006.01)

(52) U.S. Cl.
CPC ..... *A47C 27/063* (2013.01)
USPC ..... 66/170

(58) Field of Classification Search
USPC ..... 66/174, 194, 202; 139/383 R, 384 R, 139/383 B; 2/158, 159
See application file for complete search history.

(56) References Cited

U.S. PATENT DOCUMENTS 1,941,320 A * 12/1933 Pamplin ..... 401/7
2,101,027 A * 12/1937 David ..... 15/227
2,151,448 A * 3/1939 Amata ..... 2/158
2,342,547 A * 2/1944 Kuehnel ..... 2/158
2,624,893 A * 1/1953 Harris ..... 5/497
2,763,875 A * 9/1956 Piontkowski ..... 5/493
2,942,280 A * 6/1960 May, Jr. ..... 5/497
3,252,176 A * 5/1966 Gropper et al. ..... 15/209.1
3,337,893 A * 8/1967 Fine et al. ..... 15/111
3,711,889 A * 1/1973 Jennings ..... 15/227
3,999,233 A 12/1976 Morris
4,138,374 A * 2/1979 Currie ..... 521/48
4,308,626 A * 1/1982 Weiss ..... 5/485
4,670,930 A * 6/1987 Lu ..... 15/118
4,723,331 A * 2/1988 Weiss ..... 5/497
4,825,499 A * 5/1989 Baptiste ..... 15/227
4,865,015 A * 9/1989 Hasty et al. ..... 126/500
4,932,095 A * 6/1990 Kawase ..... 15/227
4,953,250 A * 9/1990 Brown ..... 15/104.94
4,980,941 A * 1/1991 Johnson, III ..... 5/497
4,980,943 A * 1/1991 Barber ..... 15/227
4,985,953 A * 1/1991 Seago ..... 5/497
5,029,353 A * 7/1991 Kimball et al. ..... 5/497

(Continued)

FOREIGN PATENT DOCUMENTS

CN 200620130125.7 10/2007
CN 200610123520.7 5/2008
CN 101502370 A 8/2009

*Primary Examiner* — Danny Worrell
(74) *Attorney, Agent, or Firm* — Tarter Krinsky & Drogin LLP

(57) ABSTRACT

A knitted fabric is designed and adapted to fit box springs of varying size. The knitted fabric includes four panels that each includes three layers—a middle layer, a top layer and bottom layer. The knitted fabric is elastic and stretches to fit over the box spring. The four panel construction provides a large opening on the top of the box spring, which allows the knitted fabric to be removed from the box spring without removal of the mattress.

13 Claims, 5 Drawing Sheets

(56) References Cited

U.S. PATENT DOCUMENTS

| | | | | | |
|---|---|---|---|---|---|
| 5,127,115 | A * | 7/1992 | Williams et al. | 5/497 |
| 5,134,746 | A * | 8/1992 | William | 15/227 |
| 5,249,322 | A * | 10/1993 | Seago | 5/499 |
| 5,287,574 | A * | 2/1994 | Kardell et al. | 5/499 |
| 5,483,712 | A * | 1/1996 | Greenwood | 5/493 |
| 5,554,657 | A * | 9/1996 | Brownscombe et al. | 521/48 |
| 5,603,132 | A * | 2/1997 | Zafiroglu | 5/497 |
| 5,621,931 | A * | 4/1997 | Hamilton | 5/493 |
| 5,636,393 | A * | 6/1997 | Zafiroglu et al. | 5/499 |
| 5,715,553 | A * | 2/1998 | Baron et al. | 5/493 |
| 5,733,397 | A * | 3/1998 | McDaniel | 156/66 |
| 5,765,241 | A * | 6/1998 | Macdonald | 5/497 |
| 5,809,593 | A * | 9/1998 | Edwards | 5/497 |
| 5,966,758 | A * | 10/1999 | Karam | 5/493 |
| 6,035,469 | A * | 3/2000 | Schrougham | 5/493 |
| 6,109,070 | A * | 8/2000 | Chen | 66/174 |
| 6,122,781 | A * | 9/2000 | Stephenson | 5/482 |
| 6,199,231 | B1 * | 3/2001 | Zafiroglu | 5/497 |
| 6,272,701 | B1 * | 8/2001 | Zafiroglu | 5/499 |
| 6,276,009 | B1 * | 8/2001 | Schrougham | 5/493 |
| 6,292,948 | B1 * | 9/2001 | Chen | 2/158 |
| 6,292,949 | B1 * | 9/2001 | Chang | 2/159 |
| 6,292,960 | B1 * | 9/2001 | Bowling | 5/308 |
| 6,311,525 | B1 * | 11/2001 | Marker et al. | 66/170 |
| 6,353,947 | B1 * | 3/2002 | McCain et al. | 5/500 |
| 6,427,266 | B2 * | 8/2002 | Talley-Williams | 5/482 |
| 6,499,157 | B1 * | 12/2002 | McCain et al. | 5/497 |
| 6,557,193 | B1 * | 5/2003 | Griffith | 5/493 |
| 6,716,202 | B1 * | 4/2004 | Hood | 604/290 |
| 6,883,193 | B2 * | 4/2005 | Brooks et al. | 5/497 |
| 6,886,197 | B1 * | 5/2005 | Madigan | 5/482 |
| 6,912,745 | B2 * | 7/2005 | Masoncup | 5/493 |
| 6,925,667 | B2 * | 8/2005 | Cohen | 5/493 |
| 6,971,129 | B2 * | 12/2005 | Wootten et al. | 5/493 |
| 7,007,326 | B2 * | 3/2006 | Tsiarkezos | 5/497 |
| 7,131,152 | B2 * | 11/2006 | Wootten et al. | 5/485 |
| 7,140,053 | B1 * | 11/2006 | Mangano | 5/493 |
| 7,179,007 | B2 * | 2/2007 | Wong et al. | 401/201 |
| 7,181,797 | B2 * | 2/2007 | Chase | 5/738 |
| 7,207,078 | B1 * | 4/2007 | Lakic | 5/493 |
| 7,228,581 | B2 * | 6/2007 | Mezue | 5/713 |
| 7,240,383 | B2 * | 7/2007 | Stewart | 5/497 |
| 7,337,480 | B2 * | 3/2008 | Borino | 5/493 |
| 7,398,570 | B2 * | 7/2008 | Seago | 5/497 |
| 7,856,684 | B2 * | 12/2010 | Robertson et al. | 5/497 |
| 8,015,636 | B2 * | 9/2011 | Bolish et al. | 5/496 |
| 2005/0112972 | A1 * | 5/2005 | Tsukamoto et al. | 442/189 |
| 2007/0283516 | A1 * | 12/2007 | Rasmussen et al. | 15/160 |
| 2008/0081898 | A1 * | 4/2008 | Ross et al. | 528/308.6 |

* cited by examiner

KNITTED FABRIC BED SKIRT

PRIORITY CLAIM

The present application claims priority to U.S. Provisional Application Ser. No. 61/257,280, filed on Nov. 2, 2009.

FIELD OF THE INVENTION

The present invention relates to a knitted fabric constructed to cover the exposed exterior of a box spring or platform of a bed and the method of constructing the same.

BACKGROUND

The vast majority of modern beds utilize a box spring between a mattress and a bed frame. Box springs are made to provide a softer surface on which the mattress rests, but they often lack an attractive appearance. In addition, box springs include wooden structural supports, preventing one from cleaning them in a washer and dryer.

Currently these problems are solved by bed skirts. Bed skirts are manufactured in many varieties. A first version of a bed skirt includes a fabric, which is sewn directly to the bed frame. This type of bed skirt is still difficult to clean because cleaning involves removing the fabric from the box spring and later reattaching it. A second version includes a decorative fabric that is sewn to an elasticized fabric, where the elasticized fabric is wrapped around the box spring. A problem with the second version, as well as the first, is that the bed skirt must be custom made to fit the precise dimensions of the box spring. Even within differently sized beds (such as twin, full, queen, and king), there are variations in length and width, commonly referred to as, among others, "standard" or "extra long", Existing bed skirts must be specially made for each variation of width and length.

These problems are especially true for hotels. In order to insert or remove a conventional bed skirt, a hotel housekeeper must first remove the mattress. Removing a mattress can be both time consuming and dangerous for the housekeeper, especially if the person is working alone.

SUMMARY OF THE INVENTION

In view of the deficiencies and drawbacks in the prior art, it is a primary object of the present invention to provide a garment that protects the box spring in a visually pleasing manner while being easy to wash.

It is a further object of the present invention to provide a garment that fits over a box spring and can be put in place or removed by being lifted over a mattress without removal of the mattress.

It is a further object of the present invention to provide a garment that will fit a range of sizes of box springs.

DETAILED DESCRIPTION

Figure 1:
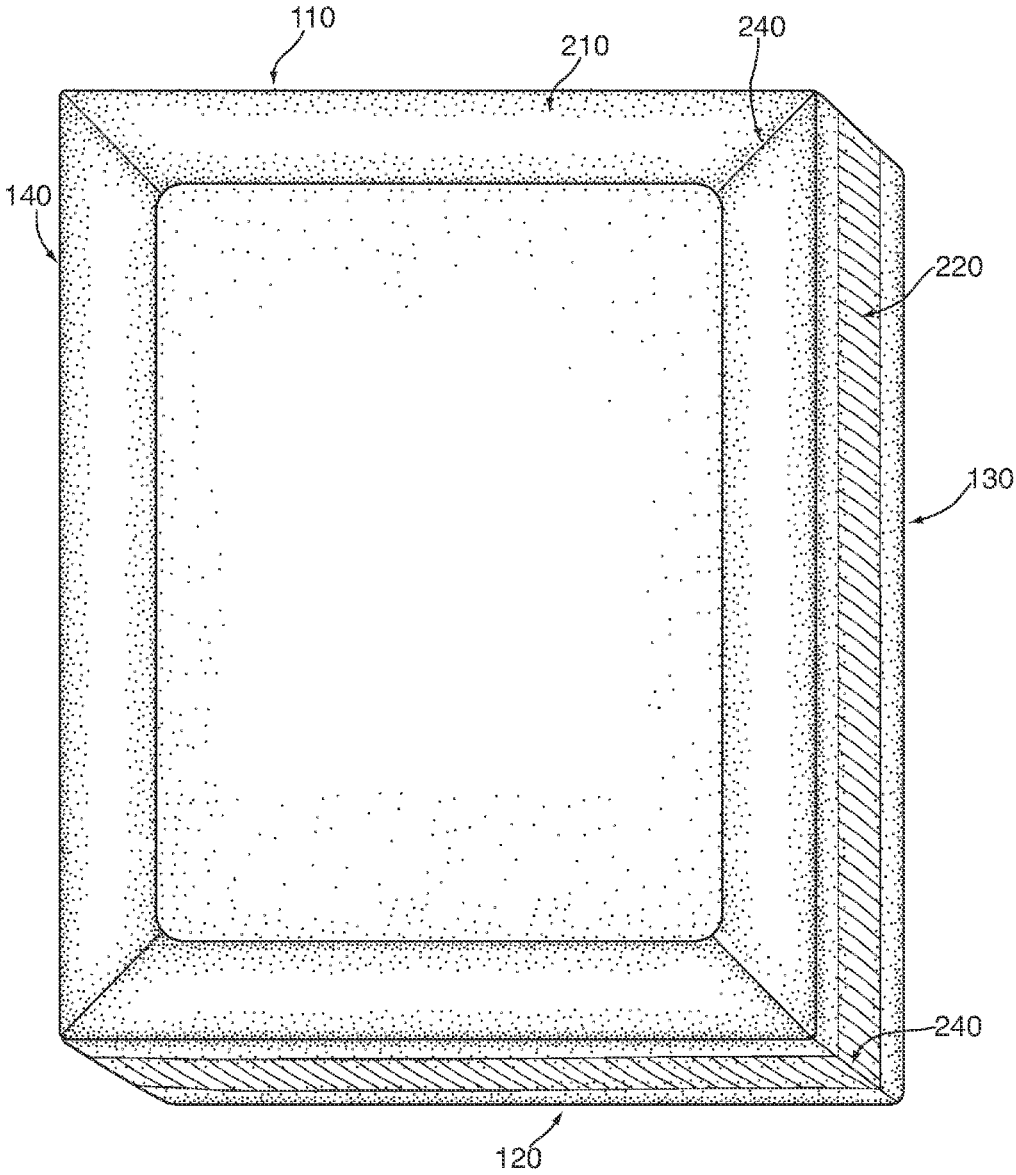
FIG. 1 is a perspective view of knitted fabric bed skirt of the present invention.

Knitted fabric 100 is a box spring garment which covers the exposed exterior of a conventional box spring, as illustrated in FIG. 1. Knitted fabric 100 wraps around the box spring and is secured in place by its elastic properties, as discussed below. Thus, knitted fabric 100 can easily be removed for cleaning and replaced. Knitted fabric 100 can be removed from a box spring with minimal movement of a mattress by stretching the knitted fabric 100 and lifting knitted fabric 100 over the mattress. Alternatively, knitted fabric 100 can removed by lifting a corner of the mattress, stretching knitted fabric 100 and resting knitted fabric 100 in the area between the mattress and box spring. This process is repeated for a second and third corner and knitted fabric 100 can be fully removed upon lifting the fourth corner the mattress. In addition, the elastic properties of knitted fabric 100 allow it to be used on a multitude of varying box spring sizes. Thus, knitted fabric 100 solves the problems present in the prior art.

Figure 2:
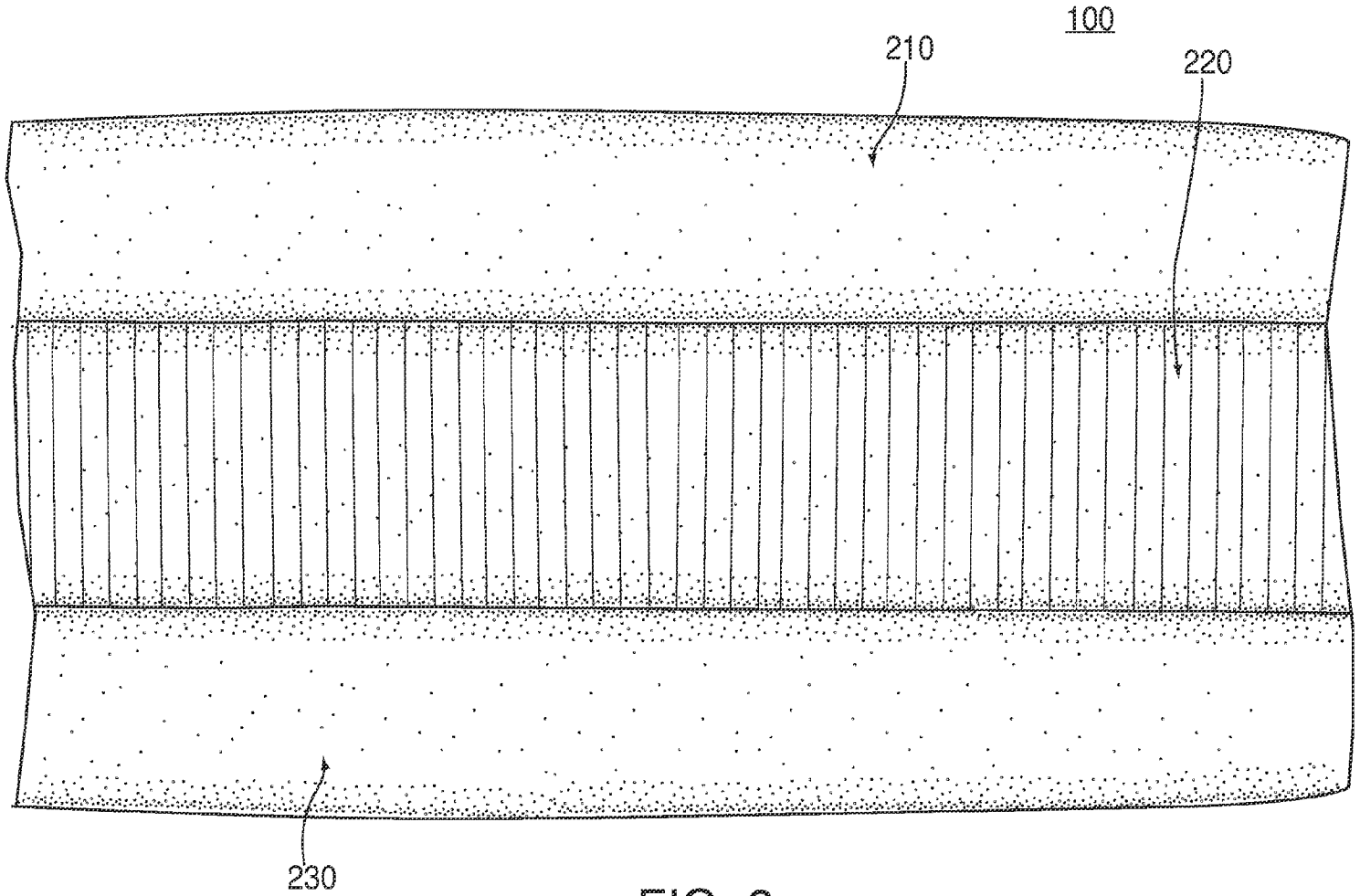
FIG. 2 is a plan view of one panel of the knitted fabric bed skirt of the present invention.

Knitted fabric 100 includes four sections, head panel 110, foot panel 120, left panel 130 and right panel 140. These four sections equate to the four sides of a box spring. As illustrated in FIG. 2, each of sections 110, 120, 130 and 140 includes a top layer 210, middle layer 220 and bottom layer 230. Top layer 210 and bottom layer 230 are preferably constructed using a spandex elastic yarn combined with polypropylene. Middle layer 220 is constructed using a less-elastic yarn, preferably polypropylene and polyester.

Figure 3:
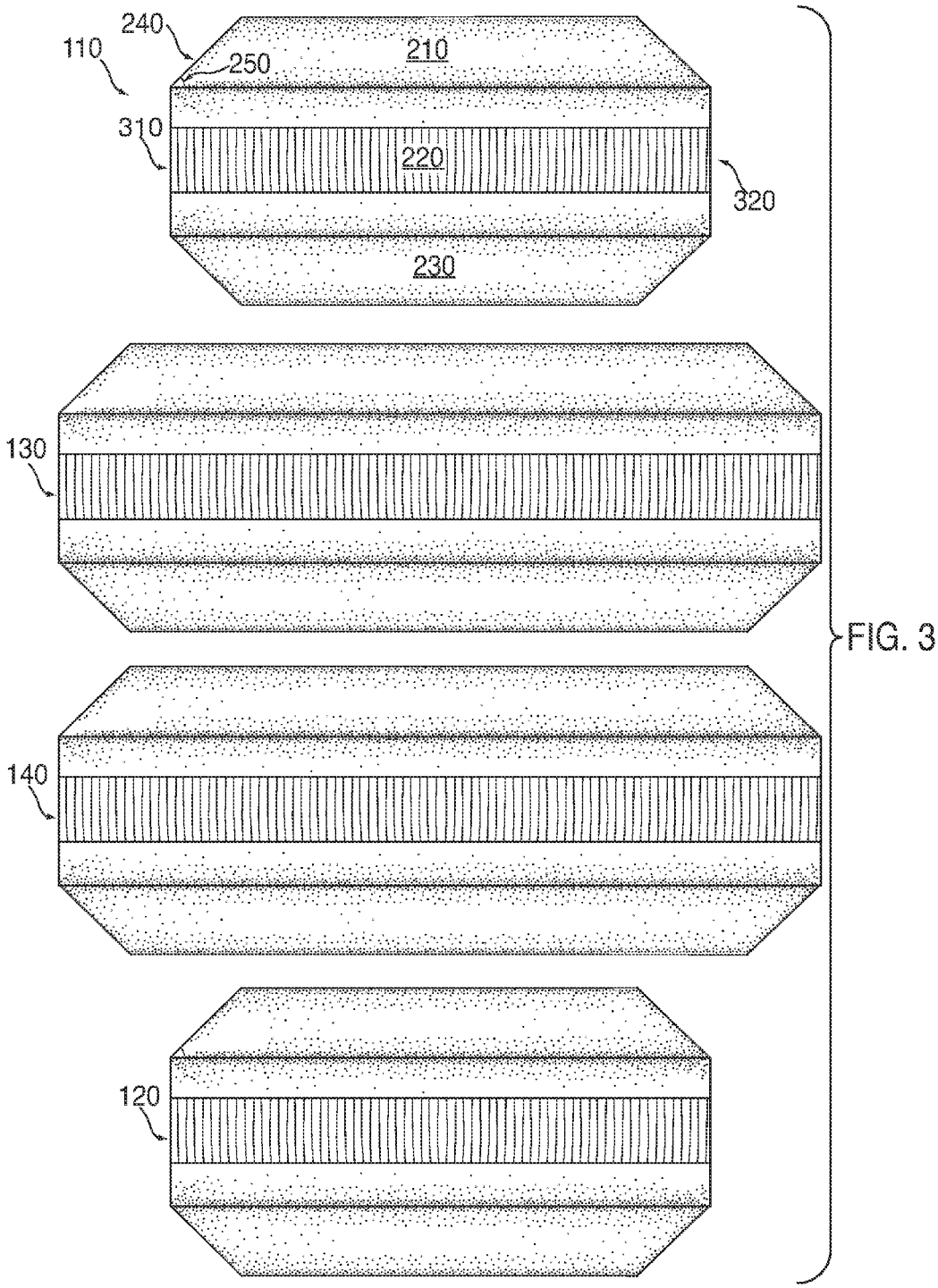
FIG. 3 is a plan view of the disassembled panels of the knitted fabric bed skirt of the present invention.

FIG. 3 illustrates the four sections of knitted fabric 100 before the sections are sewn together. In all four sections, top layer 210 and bottom layer 230 are constructed in a trapezoidal shape and include slanted edge 240. Angle 250 is preferably 45 degrees.

In constructing knitted fabric 100, one side of head panel 110 is sewn to left panel 130 and the other side of head panel 110 is sewn to right panel 140. The remaining sides of left panel 130 and right panel 140 are then sewn to the respective sides of foot panel 120.

When the four sections are sewn together, top layer 210 and bottom layer 230 fold inward so that slanted edges 240 of the respective panels join together. The combination of top layers 210 for all four panels covers the edge of the top of the box spring and the combination of bottom layers 230 for all four panels covers the edge of the bottom of the box spring. Thus, the box spring is enclosed within knitted fabric 100. Knitted fabric 100 can be easily applied and removed because of the elastic properties of the combined tops layers 210 and combined bottom layers 230.

Figure 4:
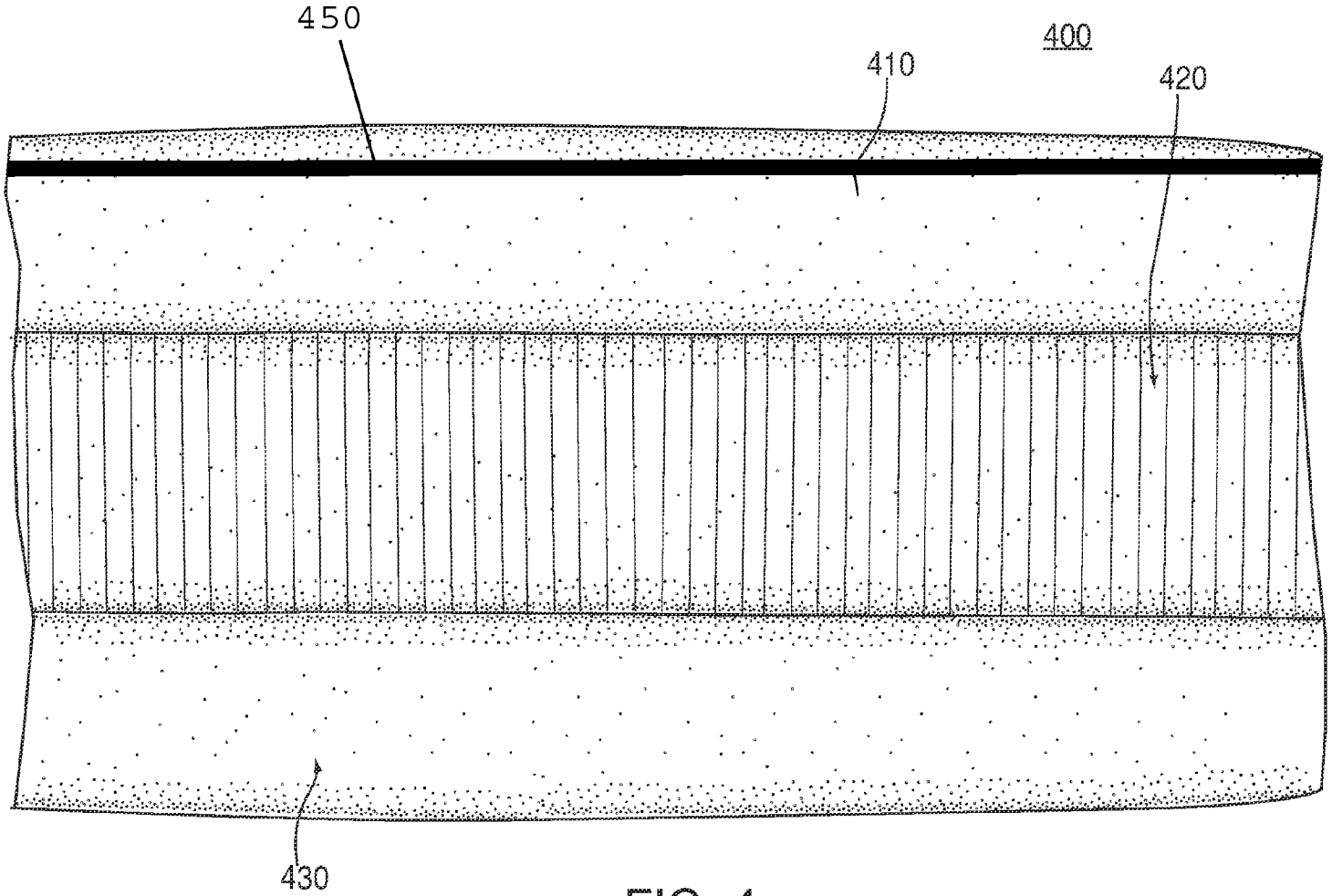
FIG. 4 is a plan view of one panel of a second preferred embodiment of the knitted fabric bed skirt of the present invention.

FIG. 4 illustrates a second preferred embodiment of the present invention. In the second preferred embodiment knitted fabric 400 includes middle layer 420, top layer 410, bottom layer 430 and a first supplemental elastic 450. The first supplemental elastic 450 comprises an elastic band that is positioned on the outermost edge of top layer 410. The supplemental elastic is preferably attached by sewing. It is also preferable for a first supplemental elastic to be sewn to all of: the head panel, the foot panel, the left panel and the right panel. The opposing ends of the first supplemental elastic can be sewn together to create a continuous loop of elastic. It has been found that the inclusion of the first supplemental elastic provides a better fit than the elasticity of the knitted fabric alone.

Figure 5:
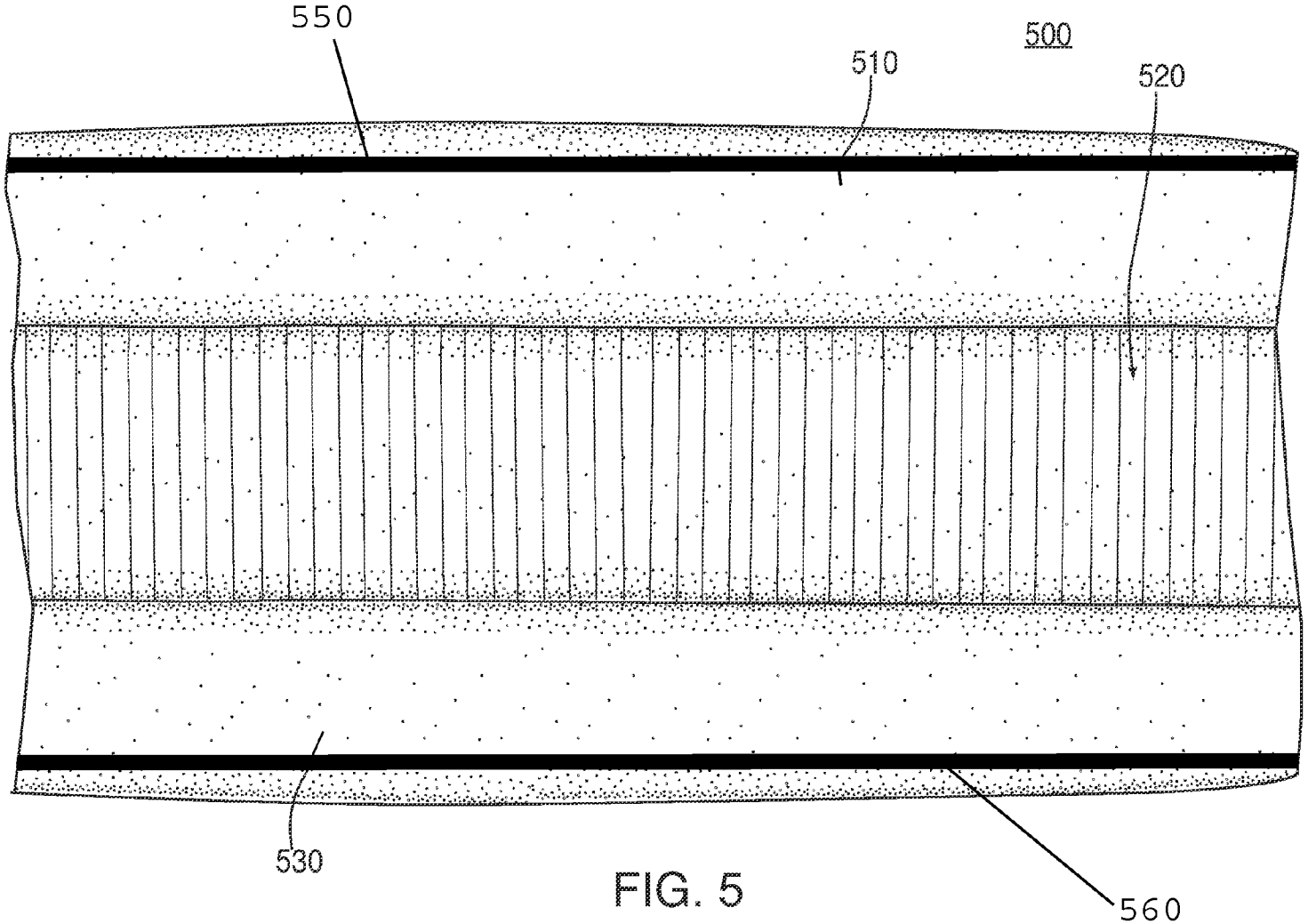
FIG. 5 is a plan view of one panel of a third preferred embodiment of the knitted fabric bed skirt of the present invention.

FIG. 5 illustrates a third preferred embodiment of the present invention. In the third preferred embodiment knitted fabric 500 includes: middle layer 520, top layer 510, bottom layer 530, first supplemental elastic 550 and second supplemental elastic 560. The second supplemental elastic 560 is equivalent to the first supplemental elastic 450, 550 and is preferably positioned on the outer edge of bottom layer 530.

Although the invention has been described in terms of particular embodiments, the embodiments are merely illustrative of an application of the principles of the invention. Numerous modifications may be made and other arrangements may be devised without departing from the spirit and scope of the invention.

The invention claimed is:

1. A garment for encasing a box spring, comprising:

four panels, each of said panels including a middle layer, a top layer and a bottom layer;

the top layers being configured to partially cover a top portion of the box spring;

the middle layers being configured to cover a side portion of the box spring;

the bottom layers being configured to partially cover a bottom portion of the box spring;

wherein the to layers expose a portion of the to portion of the box spring and the bottom layers expose a portion of the bottom portion of the box spring; and wherein said four panels are constructed entirely of a fabric comprising an elastic material that is intrinsic to the fabric.

2. The garment of claim 1, wherein the fabric is knitted fabric.

3. The garment of claim 1, wherein said panels are adapted to enclose side portions of a box spring having a varying size.

4. The garment of claim 1, further comprising a supplemental elastic on one of the top and bottom layers.

5. The garment of claim 1, further comprising supplemental elastic on the top and bottom layers.

6. The garment of claim 1, wherein said top and bottom layers are trapezoid shaped.

7. The garment of claim 1, wherein said top and bottom layers are constructed of a more elastic material than said middle layers.

8. The garment of claim 1, wherein said top and bottom layers are constructed of spandex elastic yarn combined with polypropylene.

9. A knitted fabric for encasing a box spring, comprising:

four sides, each side including a middle elastic layer, a top elastic layer and a bottom elastic layer;

a top opening formed by the top elastic layers and a bottom opening formed by the bottom elastic layers, said top opening configured to expose a top of said box spring and said bottom opening configured to expose a bottom of said box spring;

wherein said four sides are adapted to enclose a side portion of a box spring of varying size; and wherein said four sides are constructed entirely of a fabric comprising an elastic material that is intrinsic to the fabric.

10. The knitted fabric of claim 9, further comprising a supplemental elastic on an outer edge of one of the top elastic layers and the bottom elastic layers.

11. The knitted fabric of claim 9, wherein the top elastic layers and the bottom elastic layers are both trapezoid shaped.

12. The knitted fabric of claim 9, wherein said top and bottom elastic layers are constructed of a more elastic material than said middle elastic layers.

13. The knitted fabric of claim 9, wherein said top and bottom elastic layers are constructed of spandex elastic yarn combined with polypropylene.

* * * * *